United States Patent [19]

Ziller

[11] Patent Number: 4,553,368

[45] Date of Patent: Nov. 19, 1985

[54] FINWHEEL SERVO DRIVE FOR PACKAGING MACHINE

[75] Inventor: Robert E. Ziller, New Richmond, Wis.

[73] Assignee: Doboy Packaging Machinery, Inc., New Richmond, Wis.

[21] Appl. No.: 440,853

[22] Filed: Nov. 12, 1982

[51] Int. Cl.[4] ..... B65B 57/00

[52] U.S. Cl. ..... 53/51; 53/55; 53/64

[58] Field of Search ..... 53/51, 55, 64, 505

[56] References Cited

U.S. PATENT DOCUMENTS

| | | | |
|---|---|---|---|
| 3,916,598 | 11/1975 | Adams et al. | 53/55 |
| 4,128,985 | 12/1978 | Simmons | 53/64 X |
| 4,287,458 | 9/1981 | Nakamura et al. | 318/318 X |
| 4,316,566 | 2/1982 | Arleth et al. | 53/51 X |
| 4,381,637 | 5/1983 | Ballestrazzi et al. | 53/64 X |

*Primary Examiner*—John Sipos
*Assistant Examiner*—Steven P. Weihrouch
*Attorney, Agent, or Firm*—Orrin M. Haugen; Thomas J. Nikolai

[57] ABSTRACT

In a horizontal packaging machine for wrapping and sealing articles with flexible films, a servo control system for maintaining synchronism between the finwheel drive, the in-feed conveyer and the cut-off knife assembly so that proper registration of the graphic art work on the packaged article is achieved. The finwheels are driven by a D.C. motor whose armature windings are connected to the output of a servo amplifier. A master tachometer driven by the horizontal wrapper's drive motor provides a voltage which is directly proportional to the angular velocity of that drive motor. The output from the master tachometer is passed through a calibrating network and into a first input of the servo amplifier circuit. A second tachometer is coupled to the finwheel shaft and produces a feedback signal proportional to the angular velocity of the finwheels. The feedback signal is applied to the second input of the servo amplifier and functions to control the D.C. current driving the finwheel drive motor. The system also includes a digital logic network which senses a reference mark on the film from which the package is formed along with the rate at which the end-seal cutting blade is rotating to produce a supplemental or vernier control signal for adjustment of the rotational speed of the finwheel.

4 Claims, 4 Drawing Figures

FINWHEEL SERVO DRIVE FOR PACKAGING MACHINE

BACKGROUND OF THE INVENTION

This invention relates generally to packaging or wrapping machinery and more specifically to a servo control system incorporated in the packaging machinery for maintaining synchronism between the product flow, wrapper film flow and the cut-off and end-sealing assembly such that precise uniformity in the wrapped articles is achieved.

In horizontal wrapping machinery, flexible film, such as cellophane, polyethylene, paper or foil, is drawn from a supply roll and passed through a film former as the articles to be wrapped are fed along a conveyer at spaced intervals. The film former creates a tube-like enclosure about the articles and the two longitudinal edges of the film comprising the tube are pinched between one or more pairs of closely spaced finwheels whereby the longitudinal fin seal is formed on the bottom of the packages. Next, the film tube containing the articles being wrapped is passed between transversely disposed rotating or oscillating end-sealing and cut-off members which severs the tube between the articles while creating a transverse end seal on the individual packages. In such machines, the finwheels are the means for drawing the film from the supply roll and it is imperative that they by synchronized with the product conveyer and with the end-seal and cut-off knives if jamming of the machine or the stretching of the film is to be avoided. Also, where the film is preprinted with graphic information such as advertising, the article must be properly centered in the package as it is being formed and the cut-off knives must sever the wrapper at predetermined spaced locations relative to an index mark on the film if uniformity of appearance in the separate packaged articles is to be maintained.

In the past, synchronism between the conveyer, the finwheels and the end-seal/cut-off knife assembly has been maintained through the use of rather complex arrangements of gears, belts and pulleys. Typically, a so-called Cleveland Variator device, which has a high precision variable speed friction drive is made to operate in conjunction with an electric-eye correction module to sense out-of-sync conditions and to allow adjustment of the relative speed of the units to be synchronized. Each time the packaging machine was to be used to wrap different sized articles, it became necessary to readjust components of the mechanical drive system, typically by turning micrometer-like calibrated knob associated with the aforementioned variable speed friction drive. The mechanical approach to synchronization tended to be costly and added to the complexity of the machine, making setup, operation and maintenance somewhat difficult and adding to the amount of nonproductive down-time of the machine.

In addition, in the mechanical sychronization approach of the prior art, it has not generally been possible to advance or jog the finwheels independently of the conveyer and end-seal/cut-off blades. That is to say, in prior art designs, during initial threading of the film into the machine, it is necessary to run the entire machine at its preset production rate. This makes it relatively more difficult to set up the wrapping machine when it becomes necessary to change the type of film being used.

SUMMARY OF THE INVENTION

It is accordingly a principal object of the present invention to provide a new and improved electronic control system for a horizontal packaging machine which is operative to precisely maintain requisite synchronization between otherwise independently driven components of the machine.

Another object of the invention is to provide a servo drive for governing the rate of rotation of the finwheels on a horizontal packaging machine.

Still another object of the invention is to provide a servo drive and control system for a horizontal packaging machine for maintaining sychronization between the in-feed conveyer, the finwheels and the end-seal/-cut-off device.

Still a further object of the invention is to provide a servo control system of the type described in which the finwheels can be jogged and made to move independently of the in-feed conveyer and cut-off knives to facilitate initial setup of the machine.

A yet further object of the invention is to provide a servo control system of the type described in which a digital readout of production, measured in packages per minute, is provided when the system is in its normal running mode and which indicates package length in inches when the machine is stopped.

The foregoing objects and advantages are achieved by employing a master tachometer which may be mechanically connected to the in-feed conveyer line shaft of the packaging machine so as to produce a voltage proportional to the speed of the conveyer mechanism. This signal is applied through a servo control module which includes calibrating potentiometers and various switching relays and thence to the input channel of a conventional servo amplifier circuit. The output from the amplifier is applied to the independent drive motor(s) associated with the finwheels used to draw the wrapping film from the supply reels and to create the longitudinal seal. Also coupled to the shaft of the finwheel drive motor is a feed-back tachometer which is arranged to apply a voltage proportional to the rotational rate of the finwheels to a second input of the servo amplifier. The servo amplifier itself compares the two input signals and drive the finwheel motor at the appropriate set speed.

The system further includes a so-called two-way eye-correction module which functions to sense spaced fiducial marks on the wrapper film as they pass by a fixed point in the machine and to sense the angular position of the transverse cut-off knives during their rotation so as to provide a vernier-type control signal to the servo amplifier whereby precise registration between the article flow, wrapper flow and cutting and sealing structures is maintained.

In addition to feeding the tachometer signals to the servo amplifier, the control module also provides calibrated analogue signals to a digital voltmeter such that the display thereon provides a visual indication in decimal digits of the production rate of the machine when the machine is operating in its normal mode and for providing a similar visual indication of preset package length when the machine is stopped. These display features greatly enhance the ability of the human operator to perceive these perimeters and to make necessary adjustments upon conversion of the wrapper machine to handle different sized articles.

The servo control system also includes a "film jog" circuit. This circuit allows the operator to provide power only to the finwheels while the in-feed coveyer remains stationary. This facilitates the initial threading of the plastic or paper film into the machine during initial setup or adjustment. When the machine is stopped, the operator need only depress the film thread "jog" button, thereby completing a circuit which bypasses the other circuitry in the control system to apply power into the servo amplifier so that the finwheels turn at a very slow rate only so long as the jog button is held down. When in this jog mode, the operator may readily guide the film between the finwheels and bring it into position near the cut-off head for proper registration.

These and other objects and advantages of the invention will become apparent from a reading of the following detailed description of the preferred embodiment and from the accompanying drawings in which like numerals in the several views refer to corresponding parts.

DESCRIPTION OF THE PREFERRED EMBODIMENT

Figure 3:
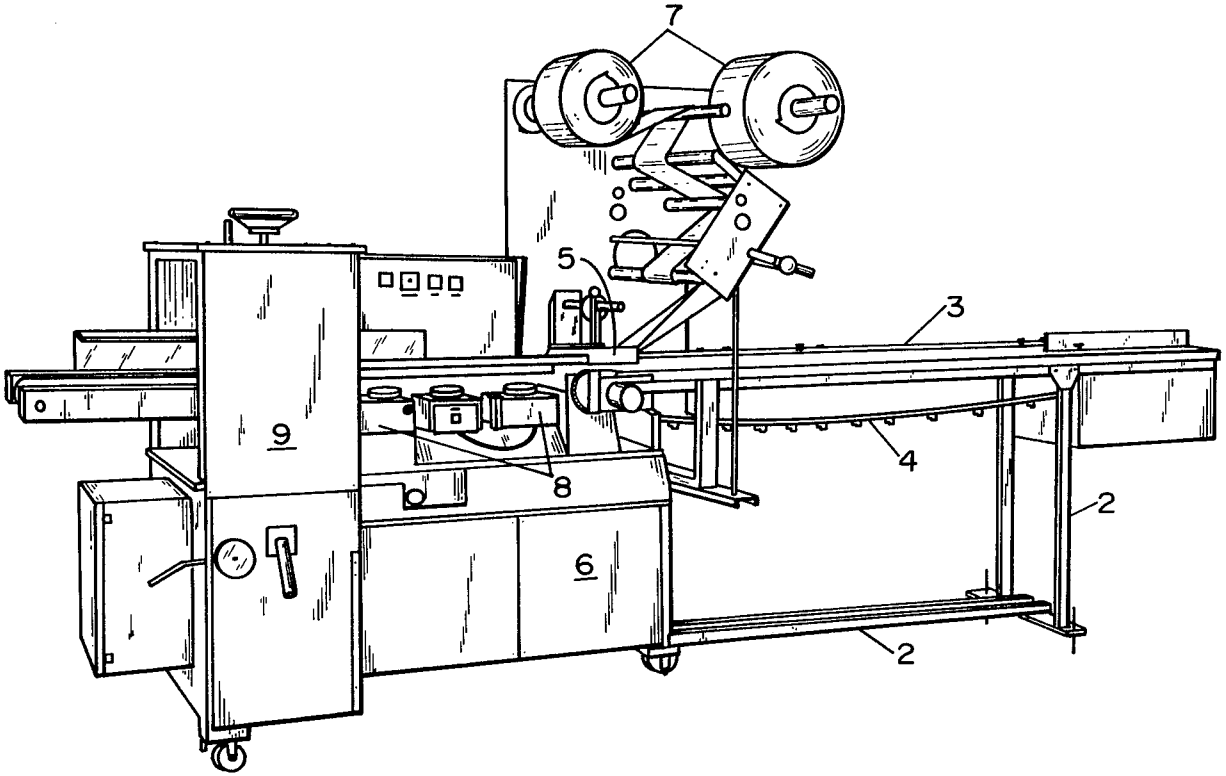
FIG. 3 is a perspective drawing of a horizontal wrapper machine on which the present invention finds use.

Referring first to FIG. 3 of the drawings, an explanation will be given as to the features of the machine in which the control system of the present invention finds use. The machine includes a frame to support an in-feed conveyer 3 in which an endless belt 4 having projecting ribs thereon is arranged to advance the articles to be wrapped toward a film former member 5. The conveyer belt is driven through a suitable chain and sprocket assembly coupled to a main drive motor of a variable speed type. The motor is contained within cabinet 6 and is, accordingly, hidden from view in FIG. 3.

Wrapping film is arranged to be played off from one or the other of the supply reels 7 and over the film former 5 where it is formed into a generally tubular configuration for enveloping the articles to be packaged arriving via the in-feed conveyer 3. The apposed edges of the film are passed between one or more pairs of finwheels 8, the finwheels of a pair being supported on parallel, vertically extending, spaced-apart shafts with the periphery of the wheels gripping the apposed edges of the film passing therebetween. Depending upon the type of wrapping material employed, the finwheels may be heated so as to create a longitudinal fin seal as the material passes through them. An electric eye control system is disposed within the housing 9 as is the end-seal and cutting-blade mechanism. The electronic eye control senses a fiducial mark on each of the wrapped articles as they enter the cutting head housing 9 for indicating the position of the package relative to the angular position of the transversely operating sealing and cutting blade. Through suitable electronic logic circuits yet to be described, a control signal is developed for increasing or decreasing the speed of the motor driving the finwheels to thereby advance or retard the position of the package relative to the blades.

Figure 1:
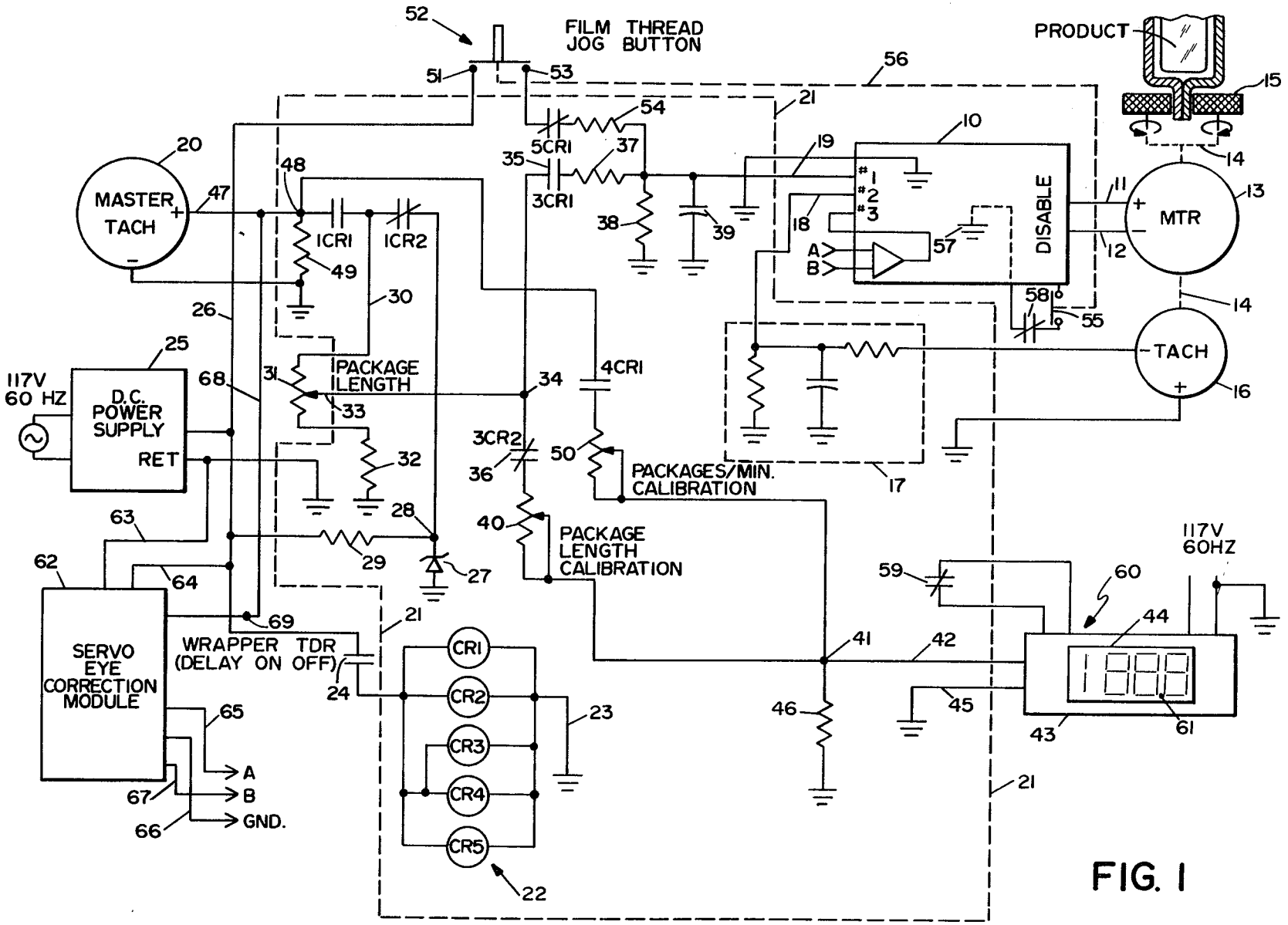
FIG. 1 is a block diagram of the finwheel servo drive system.

Now, with reference to the block diagram of FIG. 1, it can be seen that the control system of the present invention comprises a servo amplifier 10 having output lines 11 and 12 connected to the field terminals of a D.C. servo motor 13. The shaft of the motor 13 is represented schematically by the broken line 14 and, as can be seen, is arranged to drive one or more pairs of finwheels represented schematically by the side-by-side rectangle 15 in FIG. 1. As those skilled in the art are aware, the finwheels 15 comprise the portion of the wrapping machine which is effective to draw the film from its supply roll and through the film former in creating a tubular enclosure about the articles to be wrapped, which articles are arriving via an in-feed conveyer of the packaging machine. The finwheels squeeze the film surfaces together and are effective to create a longitudinal seal lengthwise along the package as it passes through the machine. While the details of the in-feed conveyer, film former and finwheels are not specifically set forth herein, those skilled in the design, manufacture and operation of automatic packaging machinery can readily perceive the way in which the present invention may be applied to appropriately drive such finwheels.

Also coupled to the shaft 14 of the servo motor 13 is a feedback tachometer 16 which comprises a direct current generator whose output voltage is directly portional to the rotational velocity of the shaft 14. The positive terminal of the feedback tachometer 16 is coupled through a filtering and attenuation network 17 to the feedback signal input terminal 18 of the servo amplifier 10 while its negative terminal is grounded. The main input to the servo amplifier 10 is applied at its input terminal 19. In normal operation, this input originates at the output terminals of a so-called "master tachometer" 20. The tachometer 20 is also a D.C. generator and is preferably coupled to the main drive motor or to the in-feed conveyer line shaft (not shown) of the wrapping machine. The main drive motor provides the force for driving the in-feed conveyer and, indirectly, for driving the transversely extending cut-off/end-seal blades of the machine.

Disposed between the master tachometer 20 and the servo amplifier 10 is a servo control module, here shown as being enclosed by the dashed lined box 21. It is seen to include a plurality of relay coils, indicated generally by numeral 22 and specifically identified by the legends CR 1 through CR 5, inclusive. Each of the relay coils has one side connected to ground, as at 23, while the other terminals thereof are preferably coupled through the contacts 24 of a time delay relay (not shown) to the output of a DC power supply 25. The time delay relay is associated with the main motor circuit and provides a predetermined delay following deenergization of the main drive motore. The contacts corresponding to each of the relays CR 1 through CR 5 are identified by corresponding legends and are illustrated in the schematic diagram in their normally deenergized condition. When the contacts 24 of the time delay relay close, a current flows from the power supply 25 through conductor 26 to energize the relay coils 22 and, as a result, the relay contacts labeled 1CR_ through 5CR_ reverse from the state represented in the drawing of FIG. 1.

To provide a fixed reference voltage, the servo control module 21 includes a Zener diode 27 having its anode connected to ground and its cathode coupled to a junction point 28. A resistor 29 has one terminal thereof connected to the junction 28 and its other terminal coupled to the conductor 26. The junction 28 is tied through the normally closed relay contacts 1CR2 and through a conductor 30 to one side of a potentiometer 31. The other terminal of the potentiometer is coupled through a series resistance 32 to ground. The wiper arm 33 of the potentiometer 31 is connected to a junction point 34. This junction point is the common connection between the normally open contacts 3CR1 and the normally closed contacts 3CR2 of relay CR3. The other side of the relay contacts 3CR1 are coupled through a voltage divider network including resistors 37 and 38 to the main input terminal 19 of the servo amplifier 10. A filtering capacitor 39 is connected in parallel with the resistor 38.

The second terminal of the normally closed relay contact 3CR2 is coupled through a variable resistor 40 to a junction point 41 which is tied to a first input terminal 42 of a digital voltmeter 43 having a 4 digit display 44 thereon. The other input terminal 45 of the voltmeter 43 is connected to ground. Also, a resistor 46 is connected between the junction 41 and ground. With no limitation intended the voltmeter 43 may comprise a Weston Model 2430 and, as such, includes 4 digit display with a programmable decimal point feature.

The positive output terminal 47 of the master tachometer 20 is tied to a junction point 48 which is a common connection between a shunt resistor 49 and the normally open relay contacts 1CR1 and 4CR1. A variable resistor 50 joins the other terminal of the normally open relay contacts 4CR to the aforementioned junction point 41 leading to the digital voltmeter 43 and allows for calibration so that for a given output from tachometer 20, a corresponding reading in terms of packages/-minute produced can be obtained.

The conductor 26 leads to a first pole 51 of a normally opened push button switch which is indicated generally by numeral 52. The other terminal of the normally opened switch connects through the normally closed relay contacts 5CR1 and a series resistor 54 to the main input terminal 19 of the servo amplifier 10. The same push button which cooperates with the switch contacts 51 and 53 is also arranged to operate the normally closed switch contact 55 as is indicated schematically by the broken line coupling 56. Connected in series with the switch 55 between an internal ground connection 57 in the servo amplifier 10 and the DISABLE terminal of that amplifier are the normally closed contacts 58 of the aforementioned delay-on-off time delay relay (not shown).

Finally, the servo control module includes a set of normally closed contacts 2CR1 associated with the relay coil CR2. These contacts connect to the decimal point DISABLE terminals 60 of the digital voltmeter 43 and control the presence and position of the decimal point indicator 61 in the display 44. The manner in which this function is performed will be set forth in more detail when the overall operation of the system is explained.

Also illustrated in the block diagram of FIG. 1 is the eye-correction module 62. While the internal construction of this module will be described in greater detail below in conjunction with an explanation of the digital logic circuitry of FIG. 2, suffice it for now to say that the module 62 is energized by the DC power supply 25 via conductors 63 and 64 and that it provides three separate output connections 65, 66 and 67 leading to the servo amplifier 10. That is to say, the output connectors A and B coming from the eye-correction module connect to the correspondingly labeled output terminals to the servo amplifier 10. The terminal 47 of the master tachometer 20 is also connected via conductor 68 to an input terminal 69 of the servo eye correction module.

Figure 2A:
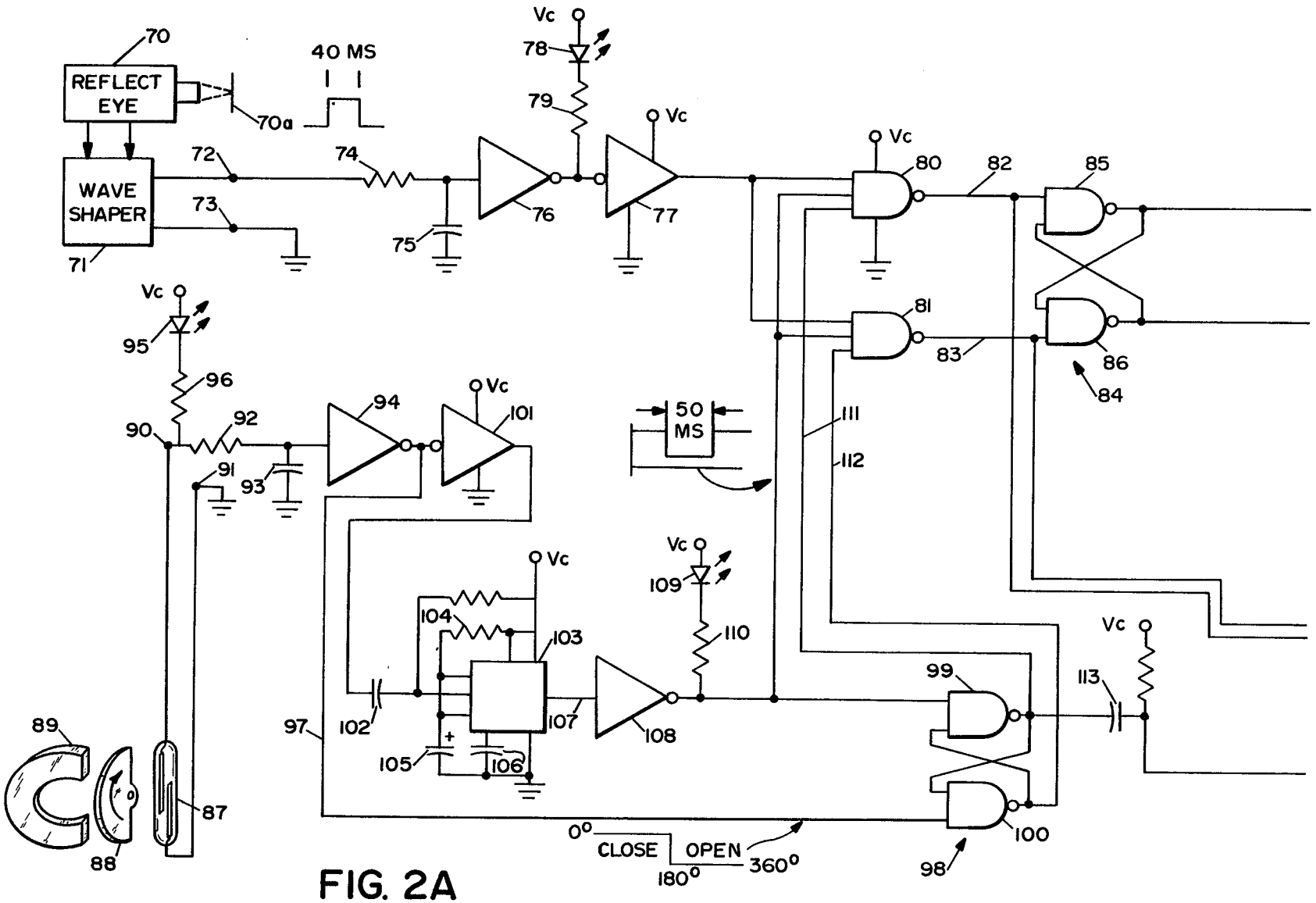
FIG. 2 is a logic diagram comprising the eye-correction module shown in FIG. 1.
Figure 2B:
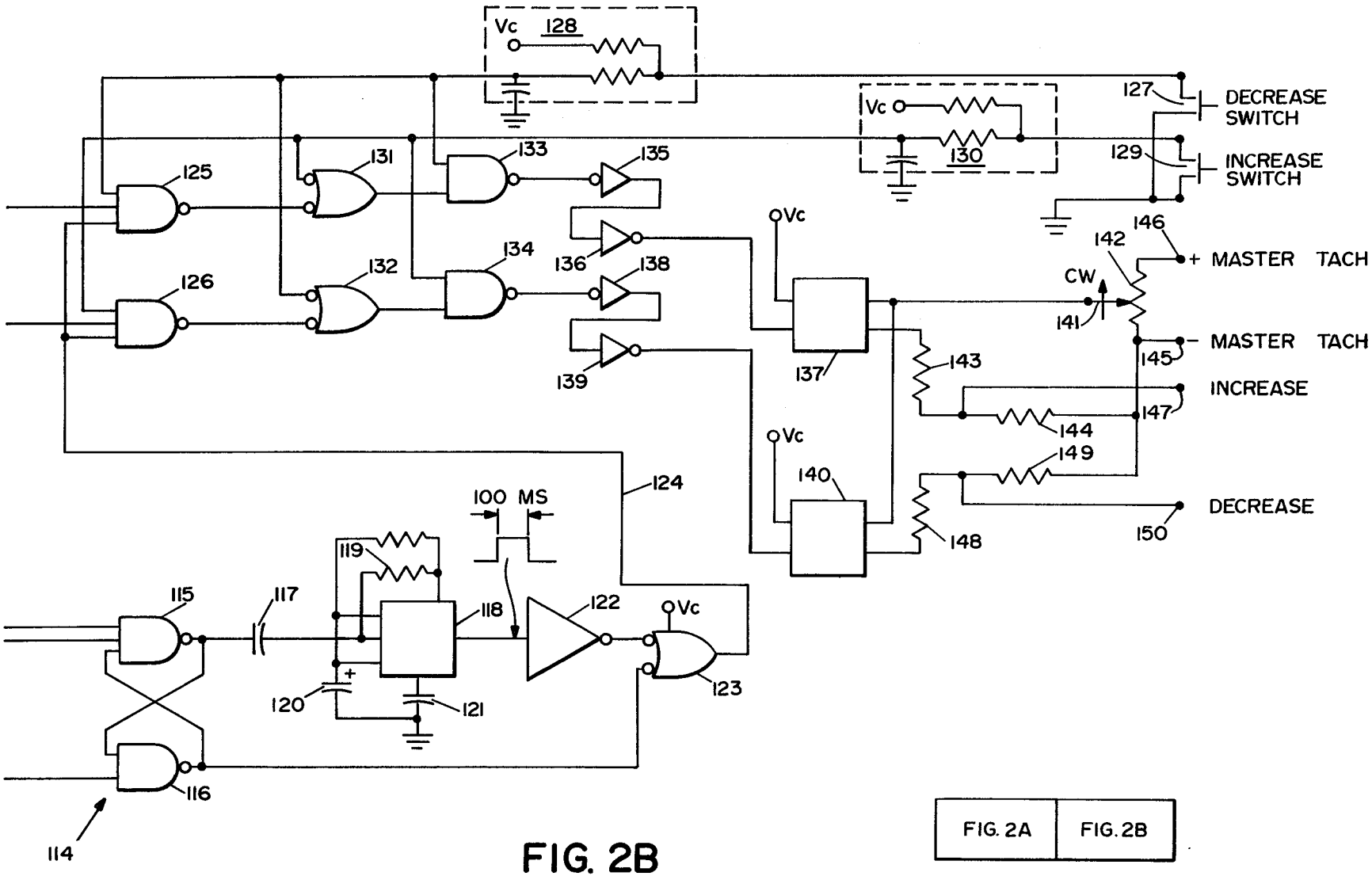

Referring next to FIG. 2 an explanation will be given as to the constructional features of the servo eye-correction module itself.

The system includes a reflect eye 70 whose electrical output is coupled through a wave shaping network 71 to the input terminals 72 and 73 of the servo eye-correction module. The reflect eye device 70 comprises a light source and lens system for transmitting a beam of light onto a fiducial mark or target **70*a* and a photoelectric cell positioned to receive the light beam reflected from the target. The wave shaper 71 includes a one-shot circuit for producing a pulse-type output approximately 40 milliseconds wide each time the target 70*a* on the film materials comprising the wrapper intercepts the light beam. This pulse signal is filtered by the low pass filter circuit including resistor 74 and capacitor 75 and is then applied through a voltage threshold establishing buffer inverter circuit 76. The output from buffer 76 is applied to a second buffer inverter circuit 77 and a light emitting diode (LED) indicator 78 is coupled in series with a current limiting resistor 79 between a source of fixed potential $V_c$ to the conductor which ties the output from inverter 76 to the input of inverter 77**.

The output from buffer inverter 77 is applied as a first input to a set of three-input NAND gates 80 and 81. The outputs from these latter two gates are applied, respectively, to the set and reset inputs 82 and 83 of a flip-flop 84, that flip-flop being comprised of two cross-connected two-input NAND gates 85 and 86.

The servo eye-correction module also receives pulse-type input signals from a reed switch 87. The making and breaking of the contacts in the reed switch 87 are controlled by a rotating ferromagnetic shield plate 88 which is operatively coupled to the shaft of the rotating cut-off and end-sealing knife (not shown) forming a part of the overall packaging machine. This rotating disc 88 is disposed between the reed switch 87 and a permanent magnet 89. The disc is shaped so that it intercepts the magnetic flux lines only during a predetermined portion of the rotation of the cut-off knives so as to produce only one switch closure for each revolution of the knife blade, the dwell time of the closure being controlled by the shape of the shield 88. This dwell time may, for example, be 180°.

The contacts of the reed switch 87 are connected to the input terminals 90 and 91 of the servo eye-correction module so that each that the contacts 87 make, the input terminal 90 will be grounded, corresponding to a binary zero 00 low condition. This signal is filtered by the combination of a series resistor 92 and a shunt capacitor 93 and the output of the filter is connected as an input to a first buffer inverter stage 94. The combination of the filter elements 92 and 93 and the inverter 94 produce a relatively "clean" binary (two-stage) signal at the output of the buffer amplifier 94. A LED 95 connected in series with a current limiting resistor 96 between the voltage source $V_c$ and the input terminal 90 may be included to provide a visual indication to the operator each time the reed switch 87 has its contacts closed.

The output from the inverter stage 94 is coupled via conductor 97 to the reset terminal of a further flip-flop, here indicated generally by numeral 98. This flip-flop is also comprised of cross-connected two-input NAND gates 99 and 100. The output from buffer inverter 94 is also applied as an input to a second stage buffer inverter 101 and the output of that circuit is coupled through a capacitor 102 to the trigger input of one-half of a Type 556 dual integrated circuit timer 103. The timer is configured to function as a monostable multivibrator or one-shot circuit. That is to say, because of the manner in which the timing resistor 104 and the timing capacitors 105 and 106 are connected to the Type 556 timer 103, once triggered the output on line 107 assumes a binary high or one state for a precise preset period of time, e.g. 50 milliseconds, and then again reverts to a binary low state.

The output from the timer 103 is inverted by the buffer circuit 108 and it is the output from that circuit which is applied as a second input to the two-input NAND gates 80 and 81. The output from inverter 108 is also applied to the Set terminal of the flip-flop 98. To provide a visual indication of the binary state of the output from the inverter 108, LED 109 is coupled through a current limiting resistor 110 from the voltage source $V_c$ to the output of the buffer inverter 108.

The Set output of the flip-flop 98 is connected by a conductor 111 to the third input of NAND gate 80 while the reset output of the flip-flop 98 is connected via conductor 112 to the third input of the NAND gate 81.

The output from the Set side of the flip-flop 98 is capacitively coupled via capacitor 113 to the reset terminal of a further flip-flop indicated generally by numeral 114, that flip-flop being comprised of cross-connected NAND gates 115 and 116. The flip-flop 114 may be switched to its Set condition by a high output signal from either NAND gate 80 or NAND gate 81. The output from the Set side of the flip-flop 114 is capacitively coupled via capacitor 117 to the other half of the Type 556 dual integrated circuit timer 118. Like the timer 103, the timer 118 is configured by external circuit convections to function in a monostable mode with the values of the timing resistor 119 and the timing capacitors 120 and 121 determining the metastable period for the one-shot circuit 118. The component values for the timer 118 are preferably set so as to produce a 100 millisecond output from the timer when triggered by a leading edge pulse occasioned by the setting of the flip-flop 114. The timer output is inverted by circuit 122 and applied as a first input to a NOR gate 123. The second input to the NOR gate 123 comes from the Reset side of the flip-flop 114. The output from the NOR gate 123 is fed over conductor 124 to first input terminals of two further NAND gates 125 and 126. The second input to the NAND gate 125 comes from the Set side of the flip-flop 84 while the second input to NAND gate 126 comes from the Reset side of that same flip-flop. A third input to the NAND gate 125 may be manually generated by closure of a push button switch 127. In that one terminal of that switch is connected to ground, whenever switch 127 is depressed, a binary low signal will be fed through the switch debounce circuit 128 to an input of NAND gate 125. In a similar fashion, operation of the manually operable push button switch 129 will cause a binary low signal to be fed through the debounce circuit 130 to the third input of NAND gate 126.

NAND gate 125 feeds its output to a first input of a further NOR circuit 131. The second input to NOR gate 131 also arrives from the debounce circuit 130 and is normally high so long as the push button switch 129 remains open. NAND gate 126 feeds its output to a further NOR gate 132 where it is logically combined with the signal present at the output of the debounce circuit 128. Again, so long as the push button switch 127 is open, that second input to NOR gate 132 will be high.

NOR gate 131 has its output coupled to a first input of NAND gate 133. That signal is then logically combined with the signal present at the output of the debounce circuit 128. Likewise, NOR gate 132 has its output coupled to a first input of NAND gate 134 and the second input to the last mentioned NAND gate arrives from the push button switch 129 via the switch debounce circuit 130.

NAND gate 133 has its output connected to a series combination of two buffer inverters 135 and 136. These buffers inverters provide requisite signal shaping so that the output therefrom can drive an opto-coupler type semi-conductor switch 137. The opto-coupler 137 is of conventional form and includes in a single package a light emitting diode and a photosensitive semi-conductor switch. When the LED is energized, the light therefrom causes the semi-conductor device to be in a low impedence state or "circuit-closed"0 condition. When the LED is not energized, the semi-conductor switching device will be in a high impedence state or "circuit-open" condition.

The output from NAND gate 134 is also coupled through a series string of two buffer inverters 138 and 139 to an input of a opto-coupler device 140. Each of the opto-couplers 137 and 140 has one pole of its semi-conductor switch tied in common to the wiper arm 141 of a level setting potentiometer 142. The other pole of the opto-coupler switch 137 is connected through a voltage divider, including series connected resistors 143 and 144, to a terminal 145 to which the negative terminal of the master tachometer 20 is to be connected. The positive terminal of the master tachometer is, in turn, adapted to be coupled to the terminal 146 of the servo eye-correction module and the potentiometer 142 is connected directly between the aforementioned terminals 145 and 146. The common point between the series resistors 143 and 144 is brought out to a terminal 147 which is adapted to be connected to the A-input of the servo amplifier 10 of FIG. 1.

The remaining pole of the semi-conductor switch portion of the opto-coupler 140 is also connected through voltage divider resistors 148 and 149 to the negative terminal of the master tachometer 20 via terminal 145 of the servo eye-correction module. The common point between these two series resistors is brought out to a terminal 150 which is adapted to be connected to the B-input of the servo amplifier 10 of FIG. 1.

Now that the details of the construction of the servo control module and its associated servo eye-correction module have been described in detail, consideration will now be given to the overall operation of the system to show the manner in which the various features and advantages heretofore mentioned are realized.

OPERATION

Upon power-up of the system, the wrapper start time delay relay (not shown) is energized and its relay contacts 24 immediately close while contacts 58 thereof immediately open. With contacts 24 closed, a current flows from the DC power supply 25 and through the conductor 26 and the parallel connected relay coils CR 1 through CR 5 to ground 23. This causes the corresponding contacts of the associated relay coils to reverse from the condition in which they are illustrated in FIG. 1. The master tachometer 20 which may be coupled to the main in-feed conveyer drive shaft (not shown) of the wrapper, produces a voltage proportional to the speed at which the in-feed conveyer portion of the packaging machine is operating. This signal is applied via the conductor 47, the now-closed relay contact 1CR1, the conductor 30 and the potentiometer wiper-arm 33 to the junction point 34 and from there via now-closed relay contact 3CR1 and the series resistor 37 to the input terminal 19 of the servo amplifier 10. The signal applied to terminal 19 of the servo amplifier controls the output of the amplifier which, in turn, drives the finwheel drive motor 13. The shaft 14 of the drive motor 13 is coupled to the finwheels 15 causing them to rotate at a speed determined by the direct current flowing through the motor leads 11 and 12. Assuming a constant conveyer speed, when a greater package length is desired, the operator may adjust the setting of the wiper arm 33 of the package length potentiometer 31 to thereby allow a greater portion of the output voltage from the master tachometer to reach the input terminal 19 of the servo amplifier 10 and thereby increase the speed of the finwheel drive motor 13 relative to the conveyer speed.

To provide a visual readout of the number of packages per minute being turned out by the wrapping machine, a digital readout device in the form a digital voltmeter 43 is included with the display 44 thereof conveniently positioned on the operator's panel. With the wrapping machine running, the relay contact 4CR1 will be closed, thus completing a circuit from the master tachometer 20 through the package/minute calibration resistor 50 to the input terminal 42 of the digital volt meter 43. The relay coil CR2 being energized, contacts 59 will be open and the decimal point 61 will be disabled and the resulting readout presented will be in units of hundreds/minute down to tens/minute.

When the wrapping machine is stopped, for example, to set up the machine to wrap a different article, the digital readout device 60 provides an indication of the length of the package to be processed. Specifically, with the wrapping machine de-energized, a direct current flows from the DC power supply 25, through conductor 26, resistor 29 and Zener diode 27 to ground, thereby creating a stable reference voltage at the junction point 28. This voltage may, for example, be 6.2 volts. This voltage is applied via the now-closed relay contact 1CR2 to an outer terminal of the package length potentiometer 31. The wiper arm 33 of this potentiometer is now connected through the closed relay contacts 3CR2 and the package length calibration resistor 40 to the input of the digital voltmeter 43. By proper adjustment of the calibration pot 40, this voltage can be made equal to the desired package length. For example, when the package length is set at four inches, the digital display 44 will also read 4.0. Also, because under this condition, the relay contacts 59 will be closed and the decimal point 61 will be enabled and shifted from the hundredths position to the tenths position as indicated in FIG. 1 to reflect a package length between 1.0 and 99.9 inches.

Rather straight-forward servo techniques are employed to control the speed of rotation of the finwheel. As has already been explained, coupled to the shaft 14 of the servo motor 13 is a feedback tachometer 16. The signal from the feedback tachometer will be directly proportional to the speed of rotation of the finwheel shaft 14 and this signal is coupled through a filter network 17 to the feedback terminal 18 of the servo amplifier 10. This signal is algebraically added to the voltage applied to the terminal 19 which, during normal operation, comes from the master tachometer 20. Hence, the servo amplifier 10 provides an output on lines 11 and 12 proportional to the combined signals applied to its input terminals 18 and 19. For example, let it be assumed that the operator wants to speed up the production rate of the machine. He will adjust a control (not shown) for speeding up the flow of product along the in-feed conveyer. In that the master tachometer 20 is coupled to the shaft of the in-feed conveyer, it will produce an increased voltage on the input terminal 19 of the servo amplifier 10. This, in turn, will begin increasing the speed at which the motor 13 is rotating. As the speed increases, the output from the feedback tachometer 16 also increases and, when applied to the input terminal 18 of the servo amplifier 10, approaches the voltage signal from the master tachometer. As the motor 13 continues to speed up, the feedback voltage produced by the feedback tachometer 16 comes closer and closer to the input voltage arriving from the master tachometer 20 and when the two are almost equal, the servo motor 13 ceases to speed up. It then continues to run at a constant rate, exactly proportional to the new input signal from the master tachometer 20. If the input signal applied to terminal 19 should increase, the servo motor 13 will speed up again until the output from the feedback tachometer 16 once more almost equals the (increased) value of the input voltage. Similarly, a downward adjustment of speed of the wrapper machine will be reflected in a slow-down of the rate of rotation of the flywheel drive motor 13.

As mentioned in the introductory portion of the specification, one novel feature of the invention not found in prior art packaging machines is the so-called "film jog" circuit. In the present invention, when the wrapper machine is not running, the relay contact 5CR1 will be closed and when the push button 52 is depressed, a circuit will be completed from the DC power supply 25 through the jog switch 52, the relay contact 5CR1 and the resistor 54 to the input terminal 19 of the servo amplifier 10. Operation of the push button switch 52 also causes the switch contact 55 to open, thereby removing the DISABLE condition from the servo amplifier. The voltage on the input terminal 19 will thus drive the motor 13 and the finwheels 15 independent of the operation of the main drive motor for the in-feed conveyer portion of the packaging machine. This feature is extremely helpful in initially threading the plastic wrapping film from the supply roll and between the finwheels and in properly aligning and registering the film with the cut-off knives during setup.

The servo amplifier 10 also receives a control signal from the servo eye-correction module 62. In operation, should the rate of flow of film vary with respect to the rotation of the transversely extending cut-off and end-sealing knife, unsatisfactory packaging may result, especially where the film has advertising type artwork thereon. In an extreme case, for example, if the out-of-synchronization condition should persist, it could happen that the film would be cut right through the middle of the advertising text. To eliminate that possibility, a servo eye-correction device is utilized. This device senses the position of fiducial marks provided on the film and correlates those marks with the rotation of the end-seal/cut-off knives and then produces control signals on the conductors 65 and 67 which, when applied to the corresponding input terminals A and B of the servo amplifier 10, will cause an adjustment in the rate of rotation of the finwheel drive motor 13 so as to bring the film back into proper registration relative to the operation of the cut-off knives. The manner in which the circuit operates to perform this function will now be set forth.

With reference to FIG. 2, a light and photocell combination 70 is provided for sensing an opaque mark 70*a* on the film passing through the machine. The signal developed by the photocell in the reflective eye device 70 is applied, via a wave shaping circuit 71, across the input terminals 72 and 73 of the servo eye-correction module. The wave shaper 71 typically comprises a one-shot circuit for producing a well defined two level pulse-type signal of a predetermined duration, typically 40 milliseconds. This pulse-type signal is applied through the buffer inverters 76 and 77 to two three-input NAND gates 80 and 81. It is these gates which make the logic decision as to whether the fiducial mark 70*a* is in or out of registration which respect to the rotation of the end-seal/cut-off knives of the packaging machine. NAND gate 80 will output a pulse if the print registration mark is coming in late relative to the operation of the end-seal/cut-off knife and will permit the propagation of a pulse to the servo amplifier tending to speed up the finwheels to again restore synchronization. If, on the other hand, the fiducial mark 70*a* arrives early relative to the operation of the end-seal and cut-off blade position, NAND gate 81 will output a signal which ultimately will function to produce a signal for decreasing the speed of the finwheel motor.

To understand the operation, it is to be noted that the magnetic shielding member 88 is disposed between the permanent magnet 89 and the contacts of a reed switch 87. The shield is generally semi-circular and, as such, when coupled to the shaft turning the end-seal and cut-off blade will cause the contacts of the reed switch 87 to be opened for 180° of rotation of the shaft and closed for the remaining 180°. The buffer circuit 94 along with the filter components 92 and 93 serve to clean up the pulses produced by the making and breaking of the reed switch 87 so as to create a well defined binary pulse of a predetermined amplitude on the conductor 97. This signal is applied to the Reset side of a flip-flop 98. It is also inverted by the buffer circuit 101 and applied to the trigger input of the integrated circuit timer 103. This timer is configured to produce a 50 ms pulse, termed a "null pulse", which, after being inverted by inverter 108, is applied to the Set input of the flip-flop 98. The same null pulse is applied to NAND gates 80 and 81 simultaneously. The null pulse, when low, disables these two gates. It can be seen, then, if the positive pulse coming from the wave shaper 71 arrives at the gates 80 and 81 during the time they are disabled by the low null pulse, there can be no correction or change in the speed of the finwheels in that the package is in proper synchronization. If, however, the positive pulse from the wave shaper 71 arrives prior to the generation of the null pulse by the timer circuit 103 of gates 80 and 81, only gate 80 will be fully enabled to produce an output signal setting the flip-flop 84. However, if it is assumed that the positive pulse from the wave shaper 71 arrives after the conclusion of the null pulse, gate 81 rather than gate 80 will be enabled such that the flip-flop 84 will be switched to its Set state.

Depending upon the state of flip-flop 84, either the channel including NAND gate 125, NOR circuit 131 and NAND gate 133 or the channel including NAND gate 126, NOR circuit 132 and NAND gate 134 will generate a low output. The buffer inverters 135 and 136 provide the requisite drive to operate the opto-coupler 137. Similarly, inverters 138 and 139 perform the same function for the opto-coupler 140.

Let it be assumed that the flip-flop 84 is set such that NAND gate 85 is outputting a high signal. The second input to NAND gate 125 comes from the timer circuit 118 via inverter 122 and NOR gate 123. The timer 118 is triggered upon the resetting of the flip-flop 114. When the reed switch opens, flip-flop 98 will be set and the resulting signal passing through capacitor 113 will reset the flip-flop 114. The low output from gate 116, forming a part of the flip-flop 114, is applied to a first input of the NOR circuit 123 and during the time that the one-shot circuit 118 is in its metastable state, NOR circuit 123 will be fully enabled to produce a binary "one" (high) signal to partially enable both gates 125 and 126. Under the assumed conditions, then, the output from the Reset side of flip-flop 84 will be high. Also under normal conditions, the manual switches 127 and 129 will be open such that the third input to NAND gates 125 and 126 will both be high and, hence, allowing the output from the timer 118 to propagate through NOR circuit 132 and NAND gate 134.

Thus, with the servo eye-correction module calling for a decrease in package length the output from the inverter 139 will go low and the signal from the master tachometer 20 will be applied through the dividing network 148 and 149 to yield the DECREASE signal on terminal 150. This signal, when applied to terminal B of the servo amplifier 10 reduces the effective output of the master tachometer and slows down the finwheels slightly. Similarly, if an increase had been called for by the fact that the pulse output from the wave shaper circuit 71 had occurred after the conclusion of the null pulse from the inverter 108, the appropriate signal would propagate from the Set side of the flip-flop 84 and through the gates 125, 131 and 133 and through the buffer inverters 135 and 136 to activate the opto-coupler 137. With opto-coupler 137 activated, the output from the master tachometer will be coupled through the potentiometer 142 and the voltage divider including resistors 143 and 144 so as to appear on the INCREASE terminal 147. That terminal ties to the terminal A of the servo amplifier 10 and increases slightly the amount of voltage applied to the finwheel servo drive motor 13 so as to increase its speed.

While the flip-flop 114 could itself drive the NAND gates 125 and 126 directly, it has been found that for high production rates, e.g., in excess of about 300 packages per minute, the duration of the correction signal at the output of the eye-correction module drops below 50 milliseconds and, as a result, the system's inertia prevents the system from reacting to such a short correction signal. The timer 118 provides an override to the correction signal by introducing a pulse having a predetermined width (100 milliseconds typically) through the inverter 122. NOR circuit 123 will select the longer of the two signals applied to it to make the correction to the film speed. The gate 123 thus decides whether either a 100 millisecond pulse or a pulse corresponding to one-half the package length indirectly originating at the reed switch 87, whichever is the longer, is to be propagated on to the output opto-couplers 137 and 140 to operate the finwheel servo motor 13.

The servo eye-correction circuit further includes a manual override feature. Specifically, through operation of the manual push button switches 127 and 129, a DECREASE or an INCREASE signal can be forced on to the appropriate terminal A or B of the servo amplifier 10.

If, for example, the operator wishes to slightly decrease the relative speed of the finwheel, he may depress the normally open push button switch 127 which forces a low signal into the gates 125 and 133. Assuming that push button 129 is open, a high signal is applied via the debounce circuit 130 to a first input of gate 131. With this combination of inputs applied to gates 125, 131 and 133, the inverter 136 will produce a high output signal disabling the opto-coupler 137 and precluding the generation of an output signal on terminal 147 to increase the speed of the servo control motor. At the same time, gate 126 will be outputting a low signal and, as such, gate 132 will be fully enabled as will gate 134. The low output from gate 134 enables the opto-coupler 140 and causes a DECREASE signal to appear at output terminal 150 so long as the push button switch 127 is maintained depressed. In a similar fashion, the depression of push button switch 129 will result in the deactivation of the opto-coupler 140 but the activation of the opto-coupler 137. With opto-coupler 137 activated, an INCREASE signal appears at the output terminal 147. Should the operator, by accident, depress both push button switches 127 and 129, the logic circuits 125, 126 and 131 through 134 function to produce signals deactivating both opto-couplers 137 and 140, in which event no change occurs in the signals applied to the servo amplifier.

The invention has been described herein in considerable detail, in order to comply with the Patent Statutes and to provide those skilled in the art with information needed to apply the novel principles and to construct and use such specialized components as are required. However, it is to be understood that the invention can be carried out by specifically different equipment and devices, and that various modifications, both as to equipment details and operating procedures can be effected without departing from the spirit and scope of the invention itself.

What is claimed is:

1. In an automatic article wrapping machine of the type including a supply roll of wrapping film, in-feed conveyer means adapted to be driven at predetermined adjustable rates by first electrical motor means for advancing the articles to be wrapped to a film forming station, means at said film forming station for forming said film into a tubular configuration about said articles, a pair of finwheels mounted for rotation about parallel vertical axes, the spacing between said axes being only slightly greater than twice the radii of said finwheels for gripping apposed longitudinal edge portions of the wrapping film and drawing said film from said supply roll and through said film forming station while creating a longitudinal seal between said apposed edges, and cyclically operable end-sealing and cut-off means disposed downstream of said pair of finwheels and transverse to the direction of flow of the entubed articles for sealing and severing said tube at predetermined spaced longitudinal locations, the improvement comprising:

(a) second electrical motor means separate from said first electrical motor means coupled in driving relation to said pair of finwheels;

(b) first tachometer means coupled to said first electrical motor means for producing a first electrical signal proportional to the rate at which said in-feed conveyer means is driven;

(c) second tachometer means operatively coupled to at least one of said pair of finwheels for producing a second electrical signal proportional to the angular velocity of said one of said pair of finwheels;

(d) servo amplifier means having input means and output means, said input means being coupled to receive said first electrical signal and said second electrical signal, said second electrical signal being in phase with said first electrical signal;

(e) means connecting said second electrical motor means to said servo amplifier output means to change the speed of said finwheels in response to the speed of said infeed conveyor;

(f) first photo-optic means for sensing the passage of fiducial marks on said film past a fixed reference point and producing a first pulse signal indicative thereof;

(g) second photo-optic means for sensing the disposition of said end-sealing and cut-off means and producing a second pulse signal during a predetermined portion of the operating cycle of said end-sealing and cut-off means;

(h) logic means coupled to said first and second photo-optic means for producing a third electrical signal when said first pulse signal occurs before said second pulse signal and a fourth electrical signal when said first pulse signal occurs after said second pulse signal; and (i) means coupling said third and fourth electrical signals to said servo amplifier means to change the speed of said finwheels in response to the positions of said fiducial marks and said end-sealing and cut-off means.

2. The article wrapping machine of claim 1 and further including:

(a) electrical power supply means; and (b) manually operable means for connecting said electrical power supply means to said servo amplifier input means when said first electrical motor means is not energized such that said second electrical motor means can be selectively driven independent from said first electrical motor means.

3. The article wrapping machine as in claim 1 and further including:

(a) a reference voltage source;

(b) digital display means; and (c) means including calibrating means coupling said reference voltage source to said digital display means only when said first electrical motor means is de-energized for displaying a digital number indicative of the length of the package to be formed.

4. The article wrapping machine as in claim 3 and further including:

(a) means for applying a signal proportional to said first electrical signal to said digital display means when said first electrical motor means is energized for indicating the production rate of said article wrapping machine in terms of packages per unit of time.

* * * * *